US009360249B2

(12) United States Patent
Shah

(10) Patent No.: US 9,360,249 B2
(45) **Date of Patent: *Jun. 7, 2016**

(54) GAS CONDITIONING PROCESS FOR THE RECOVERY OF LPG/NGL ($C_{2+}$) FROM LNG

(75) Inventor: Kamal Shah, Sugar Land, TX (US)

(73) Assignee: IHI E&C International Corporation, Houston, TX (US)

( * ) Notice: Subject to any disclaimer, the term of this patent is extended or adjusted under 35 U.S.C. 154(b) by 3127 days.

This patent is subject to a terminal disclaimer.

(21) Appl. No.: 10/585,970

(22) PCT Filed: Jan. 14, 2005

(86) PCT No.: PCT/US2005/001254

§ 371 (c)(1),
(2), (4) Date: Feb. 25, 2008

(87) PCT Pub. No.: WO2005/072144

PCT Pub. Date: Aug. 11, 2005

(65) Prior Publication Data

US 2008/0245100 A1 Oct. 9, 2008

Related U.S. Application Data

(60) Provisional application No. 60/536,731, filed on Jan. 16, 2004.

(51) Int. Cl.

| | |
|---|---|
| ***F25J 1/00*** | (2006.01) |
| ***F25J 3/00*** | (2006.01) |
| ***F25J 3/02*** | (2006.01) |

(52) U.S. Cl.

CPC ..... *F25J 3/0233* (2013.01); *F25J 3/0214* (2013.01); *F25J 3/0238* (2013.01); *F25J 3/0242* (2013.01);

(Continued)

(58) Field of Classification Search

CPC . F25J 2215/02; F25J 2210/62; F25J 2210/06; F25J 2210/02; F25J 3/0214; F25J 2200/70

USPC ..... 62/619, 620, 613, 612, 617, 618, 611

See application file for complete search history.

(56) References Cited

U.S. PATENT DOCUMENTS 2,952,984 A 9/1960 Marshall, Jr.
3,261,169 A 7/1966 Harmens (Continued)

FOREIGN PATENT DOCUMENTS

WO 2006004723 A1 1/2006

OTHER PUBLICATIONS

Chen et al., "Analysis of Temperature and Pressure Changes in Liquified Natural Gas (LNG) cryogenic tanks," (2004), Science Direct, Cryogenics 44, 701-709.*

(Continued)

*Primary Examiner* — Allen Flanigan
*Assistant Examiner* — Jason Thompson
(74) *Attorney, Agent, or Firm* — Rothwell, Figg, Ernst & Manbeck, P.C.

(57) ABSTRACT

Liquified petroleum gas or natural gas liquids may be recovered from liquified natural gas by receiving an input stream comprising substantially rich liquified natural gas, splitting the input stream into a direct stream and a bypass stream, heating the direct stream in a cross-exchanger to produce a stream of heat rich liquified natural gas, splitting the heated rich liquified natural gas into a primary column feed, an optional bypass stream and a secondary column feed.

22 Claims, 3 Drawing Sheets

(52) U.S. Cl.
CPC ..... *F25J 2200/02* (2013.01); *F25J 2200/72* (2013.01); *F25J 2210/06* (2013.01); *F25J 2235/60* (2013.01); *F25J 2245/02* (2013.01)

(56) References Cited

U.S. PATENT DOCUMENTS

| | | | | |
|---|---|---|---|---|
| 3,524,897 | A | 8/1970 | Kniel | |
| 3,702,541 | A * | 11/1972 | Randall et al. | 62/622 |
| 3,837,172 | A | 9/1974 | Markbreiter et al. | |
| 4,142,876 | A * | 3/1979 | Zahn et al. | 62/618 |
| 4,617,039 | A * | 10/1986 | Buck | 62/621 |
| 4,869,740 | A * | 9/1989 | Campbell et al. | 62/621 |
| 5,114,451 | A * | 5/1992 | Rambo et al. | 62/623 |
| 5,359,856 | A * | 11/1994 | Rhoades et al. | 62/611 |
| 5,555,748 | A | 9/1996 | Campbell et al. | |
| 5,881,569 | A * | 3/1999 | Campbell et al. | 62/621 |
| 5,916,260 | A * | 6/1999 | Dubar | 62/613 |
| 6,237,364 | B1 | 5/2001 | Stone | |
| 6,311,516 | B1 * | 11/2001 | Key et al. | 62/619 |
| 6,367,265 | B1 | 4/2002 | Yamamoto et al. | |
| 6,367,286 | B1 * | 4/2002 | Price | 62/613 |
| 6,510,706 | B2 * | 1/2003 | Stone et al. | 62/620 |
| 6,564,579 | B1 * | 5/2003 | McCartney | 62/620 |
| 6,564,580 | B2 | 5/2003 | Bowen et al. | |
| 6,604,380 | B1 * | 8/2003 | Reddick et al. | 62/620 |
| 6,607,597 | B2 * | 8/2003 | Sun et al. | 118/309 |
| 6,907,752 | B2 * | 6/2005 | Schroeder et al. | 62/620 |
| 6,964,181 | B1 * | 11/2005 | Milios et al. | 62/620 |
| 7,069,743 | B2 * | 7/2006 | Prim | 62/620 |
| 7,155,931 | B2 | 1/2007 | Wilkinson et al. | |
| 7,165,423 | B2 | 1/2007 | Winningham | |
| 7,216,507 | B2 * | 5/2007 | Cuellar et al. | 62/620 |
| 2003/0005698 | A1 * | 1/2003 | Keller | 60/643 |
| 2003/0005722 | A1 * | 1/2003 | Wilkinson et al. | 62/613 |
| 2003/0014995 | A1 * | 1/2003 | Bowen et al. | 62/623 |
| 2005/0061396 | A1 | 3/2005 | Landry et al. | |
| 2005/0155381 | A1 | 7/2005 | Yang et al. | |
| 2005/0218041 | A1 * | 10/2005 | Yoshida et al. | 208/340 |
| 2008/0083246 | A1 * | 4/2008 | Shah et al. | 62/630 |

OTHER PUBLICATIONS

Examination Report from the Indian Patent Office in corresponding Indian application serial No. 2311/KOLNP/2006 dated Feb. 18, 2010, 5 pages.

Wankat, P.C., et al., "Two-Feed Distillation: Same-Composition Feeds with Different Enthalpies," Ind. Eng. Chem. Res. ACS, pp. 3061-3067 (1993).

* cited by examiner

GAS CONDITIONING PROCESS FOR THE RECOVERY OF LPG/NGL ($C_{2+}$) FROM LNG

CROSS-REFERENCE TO RELATED APPLICATIONS

This application is a National Phase of International Application Serial. No. PCT/US2005/001254, filed 14 Jan. 2005, which claims priority to Provisional Application Ser. No. 60/536,731, filed 16 Jan. 2004.

BACKGROUND OF THE INVENTION

1. Field of the Invention

This invention relates to the field of liquefied natural gas (LNG) gas conditioning processes, and in particular to the recovery of liquefied petroleum gas (LPG) containing propane and heavier components or natural gas liquids (NGL) containing ethane and heavier components ($C_{2+}$) from LNG.

2. Description of the Related Art

Natural gas is often produced at remote locations that are far from pipelines. An alternative to transporting natural gas through a pipeline is to liquefy the natural gas and transport it in special LNG tankers. Natural gas may be liquefied by compressing it or by cooling it. An LNG handling and storage terminal is necessary to receive the compressed or cooled liquefied natural gas and revaporize it for use. The re-vaporized natural gas may then be used as a gaseous fuel.

A typical LNG handling, storage and revaporization facility, such as the one shown in FIG. 1, may include an incoming stream of LNG 10, a ship vapor return blower 12, LNG storage and send out pumps 14, a boil off gas compression and condensation unit 16, LNG booster pumps 18, LNG vaporizers 20, and an outgoing stream to a natural gas pipeline 22.

Natural gas in general, and LNG in particular, is usually comprised mostly of methane ($C_1$). Natural gas may also, however, contain lesser amounts of heavier hydrocarbons such as ethane ($C_2$), propane ($C_3$), butanes ($C_4$) and the like, which are collectively known as propane plus, or $C_{2+}$.

Natural gas shipped over a pipeline, for example, may need to conform to a particular specification for heating value. Since various hydrocarbons have various heating values, it is often necessary to separate some or all of the heavier hydrocarbons from the methane in the LNG so that the gaseous fuel resulting from vaporizing the LNG has the right heating value. Furthermore, heavier hydrocarbons have a higher value as liquid products (for use as petrochemical feed stocks, for example) than as fuel, and it is thus often desirable to separate the heavier hydrocarbons from the methane.

A heating value specified by a pipeline may change over time. Some of the customers of the pipeline may be satisfied with lean natural gas, while others may be, willing to pay for higher heating values. A natural gas recovery system in which all incoming LNG passes through a single point of entry, or even a plurality of symmetrical points of entry, may be unable to blend heating values to suit various pipeline specifications.

Fractionation units, such as distillation or de-methanation units, may use heat exchangers to recover some of the heat left in the product stream and use it to heat the incoming feed streams. In some cases there is insufficient heat in the product for a particular hydrocarbon to be effectively separated. In some cases there is, a need to boost the heat of an incoming stream to more effectively separate a particular hydrocarbon. In some cases a middle feed, for example, receives adequate heat from the product stream while a bottom feed, for example, is too cool, and requires some further energy input to effectively separate some particular hydrocarbon.

SUMMARY OF THE INVENTION

A primary object of the invention is to overcome the deficiencies of the related art described above by providing a gas conditioning process for the recovery of liquefied petroleum gas or natural gas liquids ($C_{2+}$) from liquefied natural gas. The present invention achieves these objects and others by providing a gas conditioning process for the recovery of liquefied petroleum gas or natural gas liquids ($C_{2+}$) from liquefied natural gas.

In several aspects, the invention may provide a gas conditioning process for the recovery of liquefied petroleum gas or natural gas liquids ($C_{2+}$) from liquefied natural gas.

In particular, in a first embodiment a method for recovery of liquefied petroleum gas or natural gas liquids from liquefied natural gas may include the steps of receiving an input stream comprising substantially rich liquefied natural gas, splitting the input stream into a direct stream and a bypass stream, heating the direct stream in a cross-exchanger to produce a stream of heated rich liquefied natural gas, splitting the heated rich liquefied natural gas into a primary column feed and a secondary column feed, vaporizing at least a major portion of the secondary column feed in a vaporizer to produce a vaporized secondary column feed, fractionating the top feed, the primary column feed, and the vaporized secondary column feed in a fractionation unit to produce an overhead product stream and a bottom product stream, condensing at least a major portion of the overhead product stream by cooling the overhead product stream in the cross-exchanger to produce a condensed overhead product stream, pumping a reflux portion of the condensed overhead product stream to a top of the fractionation unit, mixing the bypass portion of the rich liquefied natural gas with a balance portion of the condensed overhead product stream to produce an output stream, and vaporizing the output stream to produce a conditioned natural gas suitable for delivery to a pipeline or for commercial use.

In a second aspect, an apparatus for recovery of liquefied petroleum gas or natural gas liquids from rich liquefied natural gas may include a fractionation unit for fractionating a top feed, a primary column feed, and a vaporized secondary column feed and producing an overhead product stream and a bottom product stream, a diverter for splitting an input stream comprising substantially rich liquefied natural gas into a direct stream and a bypass stream, a cross-exchanger receiving said direct stream and heating the direct stream to produce a stream of heated rich liquefied natural gas while condensing at least a major portion of the overhead product stream by cooling the overhead product stream to produce a condensed overhead product stream, a diverter for splitting the heated rich liquefied natural gas into the primary column feed and a secondary column feed, a vaporizer for vaporizing at least a major portion of the secondary column feed and producing the vaporized secondary column feed, a pump for pumping a reflux portion of the condensed overhead product stream to a top of the fractionation unit, a mixer for mixing a bypass portion of the rich liquefied natural gas with a balance portion of the condensed overhead product stream to produce an output stream, and an output vaporizer for vaporizing the output stream to produce a conditioned natural gas suitable for delivery to a pipeline or for commercial use.

In a third aspect, a system for recovery of liquefied petroleum gas or natural gas liquids from liquefied natural gas may include means for receiving an input stream comprising substantially rich liquefied natural gas, means for splitting the input stream into a direct stream and a bypass stream, means for heating the direct stream to produce a stream of heated rich liquefied natural gas, means for splitting the heated rich liquefied natural gas into a primary column feed and a secondary column feed, means for vaporizing at least a major portion of the secondary column feed to produce a vaporized secondary column feed, means for fractionating the top feed, the primary column feed, and the vaporized secondary column feed to produce an overhead product stream and a bottom product stream, means for condensing at least a major portion of the overhead product stream to produce a condensed overhead product stream, means for pumping a reflux portion of the condensed overhead product stream to a top of the fractionation unit, means for mixing a bypass portion of the rich liquefied natural gas with a balance portion of the condensed overhead product stream to produce an output stream, and means for vaporizing the output stream to produce a conditioned natural gas suitable for delivery to a pipeline or for commercial use.

The above and other features and advantages of the present invention, as well as the structure and operation of various embodiments of the present invention, are described in detail below with reference to the accompanying drawings.

BRIEF DESCRIPTION OF THE SEVERAL VIEWS OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

It would be desirable for a gas conditioning unit for recovering natural gas liquids such as $C_{2+}$ from liquefied natural gas to exhibit relatively high ethane recovery or liquefied petroleum gas (LPG) with very low ethane recovery, in order to meet various pipeline heating value specifications. It would be further desirable for such a gas conditioning unit to be able to divert some of the incoming liquefied natural gas around the gas conditioning unit, in order to exhibit relatively high ethane recovery or very low ethane recovery. It would be further desirable for such a gas conditioning unit to be able to mix some of the diverted rich liquefied natural gas with recovered lean liquefied natural gas from the gas conditioning unit to provide a variety of blends of heating values. It would be further desirable for such a gas conditioning unit to maintain relatively high propane plus components recovery from liquefied natural gas to meet export gas requirements. It would be further desirable for such a gas conditioning unit to vaporize or add heat to incoming streams of feed for a fractionation unit that were heated inadequately in a heat exchanger. It would be further desirable for such a gas conditioning unit to vaporize or add heat selectively to incoming streams of feed for a fractionation unit. It would be further desirable for such a gas conditioning unit to utilize conventional vaporizers, such as open rack vaporizers using seawater or cooling water, submerged combustion vaporizers using fuel gas or indirect fluid vaporizers using external heating medium, for heating requirements, since specialized equipment may not be available at every LNG terminal. Finally, it would be desirable if such a gas conditioning unit did not require the output stream of lean natural gas to be compressed, thus making it more suitable for LNG terminal applications.

Figure 1:
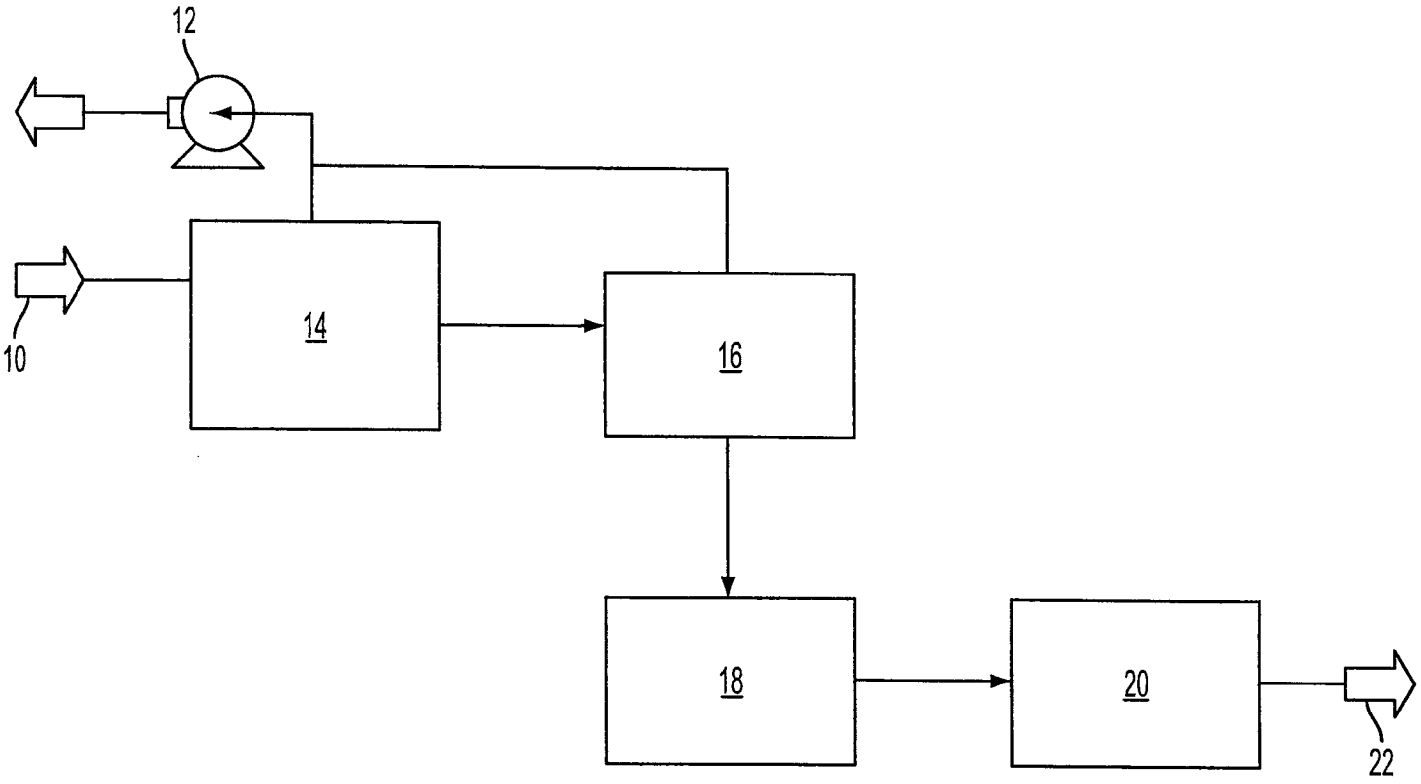
FIG. 1 RELATED ART
FIG. 1 is a schematic diagram of a vaporization process according to a related art.
Figure 2:
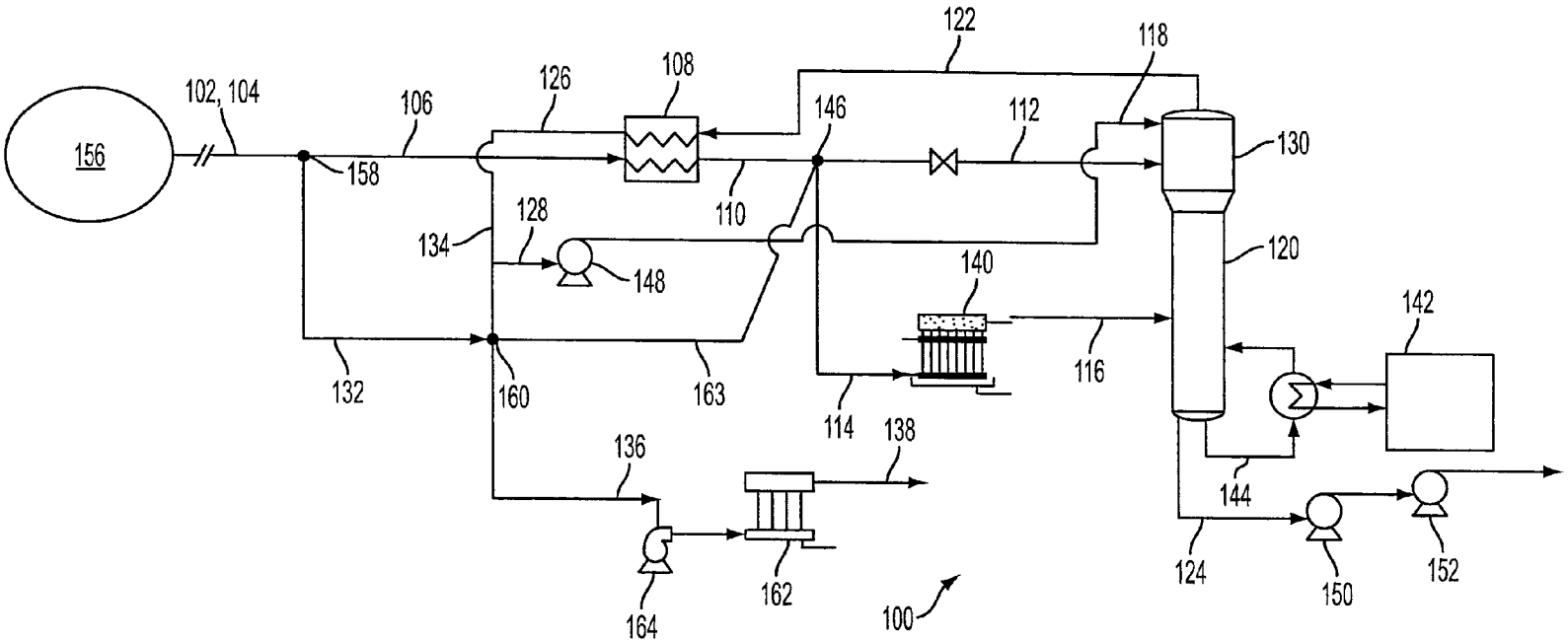
FIG. 2 is a schematic diagram of a gas conditioning process according to a first embodiment of the invention.

In FIG. 2 is shown a gas conditioning process 100 for recovery of liquefied petroleum gas or natural gas liquids from liquefied natural gas according to a first embodiment of the invention. An input stream 102 comprised substantially of rich liquefied natural gas 104 may enter gas conditioning process 100 from a source 156 such as LNG booster pumps discharge or a pipeline. In one embodiment, input stream 102 may enter gas conditioning process 100 at a temperature in a range of −240° F. to −260° F. and a pressure range of 400 to 600 psig. In one embodiment, a pressure of input stream 102 may remain substantially constant or decrease slowly as it travels from source 156 to gas conditioning process 100. In this embodiment, no pump or compressor is present between source 156 and gas conditioning process 100 to compress the rich LNG or otherwise raise its pressure substantially. This may be useful if the particular LNG terminal at which gas conditioning process 100 is installed has no pumping equipment available to raise the pressure of input stream 102 substantially. This may also reduce the capital equipment expenditure necessary to retro-fit gas conditioning process 100 to an existing LNG terminal.

In one embodiment, a diverter 158 may split input stream 102 into a direct stream 106 and a bypass stream 132. In this embodiment, diverter 158 may be a variable diverter, such as a motorized valve applied to either the conduit carrying direct stream 106 or the conduit carrying bypass stream 132. A ratio between the amount of input stream 102 sent through the conduit carrying direct stream 106 or the conduit carrying bypass stream 132 may then be adjusted by opening or closing the appropriate valve in substantial proportion to the flow desired. Diverter 158 may thus allow gas conditioning process 100 to produce a mix of conditioned, lean LNG with unconditioned rich LNG. Such mixing will in turn allow a range of mixtures and heating values of gas to be produced, from nearly pure rich LNG to nearly pure lean LNG. Gas conditioning process 100 may thus be flexible in the heating values of gases it produces relative to conventional LNG vaporization systems that send all of the rich LNG through the process.

A cross-exchanger 108 may receive direct stream 106 from diverter 158. In several embodiments, cross-exchanger 108 may be an opposite-flow heat exchanger or a cross-flow heat exchanger. In one embodiment, a pressure of direct stream 106 remains substantially constant or decreases slowly as it travels from diverter 158 to cross-exchanger 108. In this embodiment, no pump or compressor is present between diverter 158 and cross-exchanger 108 to compress direct stream 106 or otherwise raise its pressure substantially.

In one embodiment, direct stream 106 of input stream 102 may flow through cross-exchanger 108. Cross-exchanger 108 may heat direct stream 106 to produce a stream of heated rich liquefied natural gas 110. In one embodiment, cross-exchanger 108 heats direct stream 106 of input stream 102 to a temperature in a range of −115° F. to −140° F. In one embodiment, a diverter 146 may split heated rich liquefied natural gas 110 into two streams: a primary column feed 112 and a secondary column feed 114. In another embodiment, a diverter 146 may split heated rich liquefied natural gas 110 into three streams: a primary column feed 112 and a secondary column feed 114, and an optional bypass stream 163 which would connect to a mixer 160.

Gas conditioning process 100 may fractionate propane and heavier compounds contained in the rich LNG and recover a large portion of the ethane. Gas conditioning process 100 may include a fractionation unit 120 for this purpose. In one embodiment, fractionation unit 120 may be demethanizer. In another embodiment, fractionation unit 120 may be a distillation unit. In several embodiments, fractionation unit 120 may be a trayed column having approximately thirty trays, a packed column, or a combination of a packed and a trayed column. In one embodiment, fractionation unit 120 may fractionate natural gas liquid containing ethane, propane and heavier components or liquefied petroleum gas containing propane and heavier components from methane and lighter components in the rich LNG.

In one embodiment, fractionation unit 120 may have three feed streams and two product streams. A top feed stream, i.e. top feed 118, may be a reflux stream and be substantially all liquid. A middle feed stream, i.e. primary column feed 112, may be a primary feed stream. In one embodiment, primary column feed 112 may be comprised substantially of liquid. A bottom feed stream, i.e. vaporized secondary column feed 116, may be a secondary feed stream. In one embodiment, vaporized secondary column feed 116 may be substantially pre-heated.

In one embodiment, fractionation unit 120 fractionates natural gas liquid containing ethane, propane and heavier components from methane and lighter components in top feed 118, primary column feed 112, and vaporized secondary column feed 116 to produce an overhead product stream 122 and a bottom product stream 124. Overhead product stream 122 may contain mostly methane and lighter components. In one embodiment, overhead product stream 122 may be comprised substantially of vapor. In another embodiment, overhead product stream 122 may be mostly methane. In one embodiment, overhead product stream 122 may exit fractionation unit 120 at a temperature in a range of −80° F. to −130° F.

In one embodiment, the NGL stream (i.e. bottom product stream 124) may contain mostly ethane, propane and heavier components. In one embodiment, bottom product stream 124 may be comprised substantially of natural gas liquids, such as $C_{2+}$ hydrocarbons. In one embodiment, bottom product stream 124 may be a mixture of ethane, propane and heavier components fractionated from the rich LNG. In one embodiment, bottom product stream 124 may exit fractionation unit 120 at a temperature in a range of 55° F. to 1200 F. In another embodiment, bottom product stream 124 may be controlled by heat input to fractionation unit 120 to meet natural gas liquid pipeline specifications.

Primary column feed 112 may enter fractionation unit 120 directly at a temperature in a range of −115° F. to −140° F. Secondary column feed 114, on the other hand, may pass through a vaporizer 140 and be preheated to a temperature in a range of 30° F. to 60° F. before entering fractionation unit 120. In one embodiment, vaporizer 140 may vaporize at least a major portion of secondary column feed 114 and produce vaporized secondary column feed 116. In several embodiments, a heat source of vaporizer 140 may be sea-water or cooling water in the case of an open rack vaporizer, fuel gas in the case of a submerged combustion vaporizer, or an external heating medium in the case of an intermediate fluid vaporizer.

Cross-exchanger 108 may condense at least a major portion of overhead product stream 122 into lean LNG as well as preheat direct stream 106. Cross-exchanger 108 may condense overhead product stream 122 by cooling overhead product stream 122 to produce a condensed overhead product stream 126. In one embodiment, cross-exchanger 108 may cool overhead product stream 122 by rejecting heat from overhead product stream 122 to direct stream 106. In one embodiment, cross-exchanger 108 cools overhead product stream 122 to a temperature in a range of −120° F. to −145° F.

In one embodiment, cross-exchanger 108 may heat direct stream 106 with heat absorbed from overhead product stream 122. Preheating may reduce a reboiler duty of fractionation unit 120 (i.e., heating medium system capacity) and vaporizer 140 heat duty.

Part of the lean LNG coming from the cross-exchanger 108 may be returned to fractionation unit 120 as a reflux stream by a reflux pump 148. In particular, pump 148 may pump a reflux portion 128 of condensed overhead product stream 126 to a top 130 of fractionation unit 120 as top feed 118. In one embodiment, reflux portion 128 may be comprised substantially of liquid. The reflux stream may increase propane recovery and reduce the amount of ethane removed in fractionation unit 120. The remaining lean LNG stream may be mixed with the bypass stream (rich LNG) 132 and an optional bypass stream 163 and flow to pumping and vaporizing systems.

In one embodiment, bypass portion 132 of input stream 102 from LNG booster pumps may bypass cross-exchanger 108 as a bypass stream and mix with lean LNG coming from fractionation unit 120. The combined stream may then flow to pumping 164 and vaporizing 162 systems. In particular, in one embodiment, a mixer 160 may mix a bypass portion 132 of rich liquefied natural gas 104 and an optional bypass stream 163 from split 146 with a balance portion 134 of condensed overhead product stream 122 to produce an output stream 136. An output vaporizer 162 may vaporize output stream 136 to produce a conditioned natural gas 138 suitable for delivery to a pipeline or for commercial use.

In one embodiment, gas conditioning process 100 may include a re-boiler 142 adding heat to a bottom re-boil stream 144 from fractionation unit 120 and re-injecting bottom re-boil stream 144 into fractionation unit 120. In one embodiment, re-boiler 142 may be a submerged combustion vaporizer.

The NGL from fractionation unit 120 may be pumped by two pumps (a booster pump 150 and a high pressure pump 152) to NGL pipeline pressure and enter the NGL pipeline 154. Booster pump 150 may be used to provide the net positive suction head (NPSH) required by high pressure pump 152.

In a second embodiment, a method 100 for recovery of liquefied petroleum gas or natural gas liquids from liquefied natural gas may include the steps of receiving an input stream comprising substantially rich liquefied natural gas 104, heating a direct stream 106 of input stream 102 in a cross-exchanger 108 to produce a stream of heated rich liquefied natural gas 110, splitting heated rich liquefied natural gas 110 into a primary column feed 112, optional bypass stream 163 and a secondary column feed 114, vaporizing at least a major portion of secondary column feed 114 in a vaporizer 140 to produce a vaporized secondary column feed 116, fractionating a top feed 118, primary column feed 112, and vaporized secondary column feed 116 in a fractionation unit 120 to produce an overhead product stream 122 and a bottom product stream 124, condensing at least a major portion of overhead product stream 122 by cooling overhead product stream 122 in cross-exchanger 108 to produce a condensed overhead product stream 126, pumping a reflux portion 128 of condensed overhead product stream 126 to a top 130 of fractionation unit 120, mixing a bypass portion 132 of input stream 102 and optional bypass stream 163 With a balance portion 134 of condensed overhead product stream 122 to produce an output stream 136, vaporizing output stream 136 to produce a conditioned natural gas 138 suitable for delivery to a pipeline or for commercial use.

Figure 3:
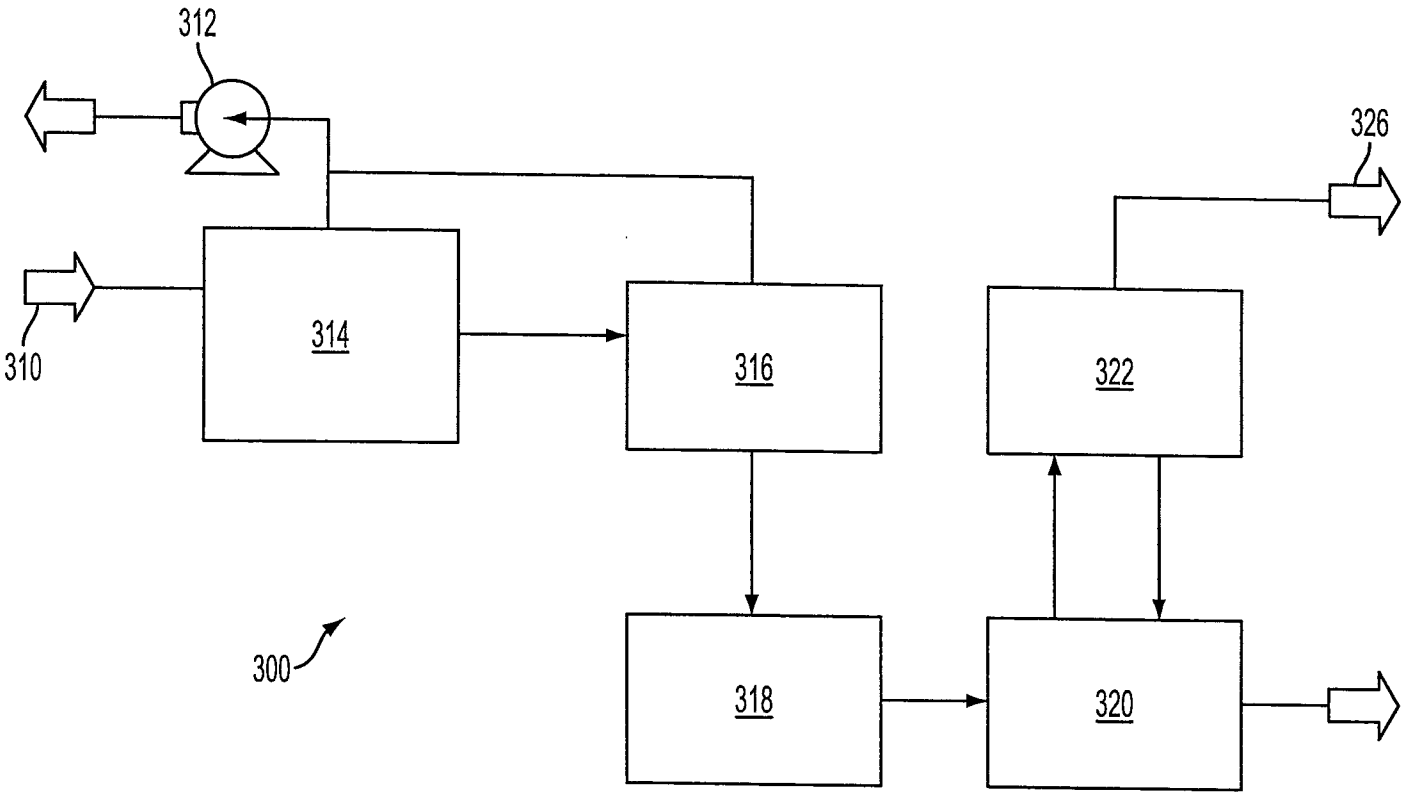
FIG. 3 is a schematic diagram of an LNG handling and storage facility according to an embodiment of the invention.

In FIG. 3 is shown an LNG handling and storage facility 300 according to third embodiment of the invention. LNG handling and storage facility 300 may include an incoming stream of LNG 310, a ship vapor return blower 312, LNG storage and send out pumps 314, a boil off gas compression and condensation unit 316, LNG booster pumps 318, LNG vaporizers 320, gas conditioning process 322 for recovery of liquefied petroleum gas or natural gas liquids from liquefied natural gas, and an outgoing stream of mixed NGL to a natural gas pipeline 326.

The foregoing has described the principles, embodiments, and modes of operation of the present invention. However, the invention should not be construed as being limited to the particular embodiments described above, as they should be regarded as being illustrative and not restrictive. It should be appreciated that variations may be made in those embodiments by those skilled in the art without departing from the scope of the present invention.

While the invention has been described in detail above, the invention is not intended to be limited to the specific embodiments as described. It is evident that those skilled in the art may now make numerous uses and modifications of and departures from the specific embodiments described herein without departing from the inventive concepts.

While various embodiments of the, present invention have been described above, they should be understood to have been presented by way of examples only, and not limitation. Thus, the breadth and scope of the present invention should not be limited by the above described embodiments.

Obviously, numerous modifications and variations of the present invention are possible in light of the above teachings. It is therefore to be understood that the invention may be practiced otherwise than as specifically described herein.

What is claimed is:

1. A method for recovery of liquefied petroleum gas or natural gas liquids from liquefied natural gas and producing a desired mixture of conditioned lean liquefied natural gas and unconditioned rich liquefied natural gas, the method comprising:

receiving an input stream comprising substantially rich liquefied natural gas;

splitting the input stream into a direct stream and a bypass stream;

heating said direct stream in a cross-exchanger to produce a stream of heated rich liquefied natural gas;

splitting said heated rich liquefied natural gas into a primary column feed and a secondary column feed;

vaporizing feed from said secondary column feed in a vaporizer to produce a vaporized secondary column feed;

fractionating a top feed, said primary column feed, and said vaporized secondary column feed in a fractionation unit to produce an overhead product stream and a bottom product stream;

condensing feed from said overhead product stream by cooling said feed from said overhead product stream in said cross-exchanger to produce a condensed overhead product stream;

pumping a reflux portion of said condensed overhead product stream to a top of said fractionation unit as said top feed;

mixing said bypass stream with a balance portion of said condensed overhead product stream to produce an output stream; and vaporizing said output stream to produce a conditioned natural gas suitable for delivery to a pipeline or for commercial use, wherein said bypass stream provides a supply of rich liquefied natural gas to be blended with said condensed overhead product stream to provide said desired mixture of conditioned lean liquefied natural gas and unconditioned rich liquefied natural gas.

2. The method of claim 1, wherein said natural gas liquids comprise $C_{2+}$hydrocarbons.

3. The method of claim 1, wherein said input stream is at a temperature in a range of −240° F. to −260° F.

4. The method of claim 1, wherein said cross-exchanger heats said direct stream of said input stream to a temperature in a range of −115° F. to −140° F.

5. The method of claim 1, wherein said vaporizer heats said secondary column feed to a temperature in a range of 30° F. to 60° F.

6. The method of claim 1, wherein said cross-exchanger cools said overhead product stream to a temperature in a range of −120° F. to −145° F.

7. The method of claim 1, wherein said reflux portion is comprised substantially of liquid.

8. The method of claim 1, wherein said primary column feed is comprised substantially of liquid.

9. The method of claim 1, wherein said vaporized secondary column feed is substantially pre-heated.

10. The method of claim 1, wherein said overhead product stream is comprised substantially of vapor.

11. The method of claim 1, wherein said bottom product stream is comprised substantially of natural gas liquids.

12. The method of claim 1, wherein said overhead product stream exits said fractionation unit at a temperature in a range of −80° F. to −130° F.

13. The method of claim 1, wherein said bottom product stream exits said fractionation unit at a temperature in a range of 50° F. to 120° F.

14. The method of claim 1, wherein said direct stream of said input stream is heated by absorbing heat from said overhead product stream.

15. The method of claim 1, wherein said overhead product stream is condensed by rejecting heat to said direct stream of said input stream.

16. An apparatus for recovery of liquefied petroleum gas or natural gas liquids from liquefied natural gas and producing a desired mixture of conditioned lean liquefied natural gas and unconditioned rich liquefied natural gas, comprising:

a fractionation unit for fractionating a top feed, a primary column feed, and a vaporized secondary column feed and producing an overhead product stream and a bottom product stream;

a diverter for splitting an input stream comprising substantially rich liquefied natural gas into a direct stream and a bypass stream;

a cross-exchanger receiving said direct stream and heating said direct stream to produce a stream of heated rich liquefied natural gas while condensing feed from said overhead product stream to produce a condensed overhead product stream;

a diverter for splitting said heated rich liquefied natural gas into said primary column feed, optional bypass stream and a secondary column feed;

a vaporizer for vaporizing feed from said secondary column feed and producing said vaporized secondary column feed;

a pump for pumping a reflux portion of said condensed overhead product stream to a top of said fractionation unit as said top feed;

a mixer for mixing a bypass portion of said rich liquefied natural gas with a balance portion of said overhead product stream to produce an output stream;

an output vaporizer for vaporizing said output stream to produce a conditioned natural gas suitable for delivery to a pipeline or for commercial use, wherein said bypass stream provides a supply of rich liquefied natural gas to be blended with said condensed overhead product stream to provide said desired mixture of conditioned lean liquefied natural gas and unconditioned rich liquefied natural gas.

17. The apparatus of claim 16, wherein said fractionation unit is selected from the group consisting of:

a trayed column having approximately thirty trays, a packed column, and a combination of said packed and said trayed column.

18. The apparatus of claim 16, wherein said fractionation unit fractionates ethane, propane and heavier components from methane and lighter components in said top feed, said primary column feed, and said vaporized secondary column feed.

19. The apparatus of claim 16, comprising further a reboiler adding heat to a bottom re-boil stream from said fractionation unit and re-injecting said bottom re-boil stream into said fractionation unit.

20. The apparatus of claim 19, wherein said re-boiler comprises a submerged combustion vaporizer.

21. The apparatus of claim 16, wherein a heat source of said vaporizer is selected from the group consisting of:

sea-water, cooling water for open rack vaporizers, fuel gas for submerged combustion vaporizers, and indirect heating fluid for indirect fluid vaporizers.

22. A system for recovery of liquefied petroleum gas or natural gas liquids from liquefied natural gas and producing a desired mixture of conditioned lean liquefied natural gas and unconditioned rich liquefied natural gas, comprising:

means for receiving an input stream comprising substantially rich liquefied natural gas;

means for splitting the input stream into a direct stream and a bypass stream;

means for heating a direct stream of said input stream to produce a stream of heated rich liquefied natural gas;

means for splitting said heated rich liquefied natural gas into a primary column feed and a secondary column feed;

means for vaporizing feed from said secondary column feed to produce a vaporized secondary column feed;

means for condensing feed from said overhead product stream to produce a condensed overhead product stream;

means for pumping a reflux portion of said condensed overhead product stream to a top of said fractionation unit as said top feed;

means for mixing a bypass portion of said rich liquefied natural gas with a balance portion of said condensed overhead product stream to produce an output stream;

means for vaporizing said output stream to produce a conditioned natural gas suitable for delivery to a pipeline or for commercial use, wherein said bypass stream provides a supply of rich liquefied natural gas to be blended with said condensed overhead product stream to provide said desired mixture of conditioned lean liquefied natural gas and unconditioned rich liquefied natural gas.

* * * * *